United States Patent [19]

Merkel et al.

[11] 3,978,624

[45] Sept. 7, 1976

[54] DEVICE FOR ENDING THE FEED MOVEMENT OF A GRINDING WHEEL

[75] Inventors: Rudolf Merkel, Coburg-Scheuerfeld; Friedrich Schnell; Ewald Weber, both of Coburg, all of Germany

[73] Assignee: Werkzeugmaschinenfabrik Adolf Waldrich Coburg, Coburg, Ay., Germany

[22] Filed: May 7, 1975

[21] Appl. No.: 575,270

[30] Foreign Application Priority Data

May 11, 1974 Germany ..... 2422940

[52] U.S. Cl. ..... 51/165.92

[51] Int. Cl.[2] ..... B24B 49/10

[58] Field of Search..... 51/165 R, 165.75, 165.92

[56] References Cited

UNITED STATES PATENTS

| | | | |
|---|---|---|---|
| 2,256,120 | 9/1941 | Lovenston | 51/165.75 X |
| 2,961,394 | 11/1960 | Williams et al. | 51/165 R X |

FOREIGN PATENTS OR APPLICATIONS

| | | | |
|---|---|---|---|
| 1,371,307 | 7/1963 | France | 51/165.92 |

*Primary Examiner*—Harold D. Whitehead
*Attorney, Agent, or Firm*—Woodhams, Blanchard and Flynn

[57] ABSTRACT

Means for terminating the infeed of a machine tool, particularly a grinder. An electrode is imbedded within the tool and is exposed at the active surface thereof, such as the grinding surface of a grinder, and a sensing voltage is placed between said electrode and the workpiece. Suitable switching means is placed within the circuit of said electrode and workpiece which switching means will be activated upon the occurrence of a spark between said electrode and the workpiece. Activation of said switching means then activates further means to terminate the infeed of the tool. The circuitry supplying the voltage aforesaid may include a transformer having a plurality of output taps by which a plurality of voltages may be applied between the electrode and the workpiece and such circuitry will in such case include switching means automatically responsive to said different selected voltages. Thus, one voltage may be utilized at a first distance for terminating a rapid infeed, the occurrence of a spark at such distance then terminating the rapid feed, imposing a second and lesser voltage between the tool and the workpiece, and activating a creep feed and finally activating a switch sensitive to such second voltage which, when a second selected distance is reached, may be utilized to stop the power feed entirely.

11 Claims, 4 Drawing Figures

DEVICE FOR ENDING THE FEED MOVEMENT OF A GRINDING WHEEL

FIELD OF THE INVENTION

The invention relates to a device for terminating the feeding movement of a rotating tool which is carried by a tool spindle, in particular a grinding wheel, upon reaching a predetermined small distance between an active tool surface and a workpiece surface.

BACKGROUND OF THE INVENTION

In the working of workpieces with a chip-removing rotating tool, the feed movement of the tool must stop as closely as possible to a point spaced a predetermined small distance between the active tool surface and the workpiece surface, so that in consideration of this predetermined distance the final feed of the tool can progress at the desired amount. Furthermore, it is also desired that the feed movement which takes place as much as possible in order to save time in a rapid and power driven traverse, upon reaching a selected distance is switched over from rapid and power driven traverse to creep feed and this feed movement is then ended upon reaching a selected still smaller distance between the active tool surface and the workpiece surface. A device for ending the feed movement is particularly useful in the case of grinding wheels, because these wear as is known and must then be dressed. After dressing they have a smaller diameter, whereby the correction of this diameter difference is time consuming upon renewal of feed after the dressing if one is to be successful in limiting the advance of the grinding wheel feed so that the active surface of the grinding wheel assumes a predetermined distance from the workpiece surface.

Mechanically operating stopping devices are known, in which the feed path is detected through a feeler system contacting the workpiece. For this purpose, there exists also a device in which the feeler system is connected with the sleeve of a dressing device, so that the reduction of the grinding wheel diameter which is caused by the dressing operation is compensated (German OS No. 2,135,473). However, this mechanical system is susceptible to wear, namely clearance in its moving parts and also to chips or dust from the workpiece. Starting or positioning errors of the feeler on the workpiece surface can also cause inaccuracies.

A different known stopping device (German Patent No. 1,107,553) uses a thin feeler band of metal, plastic, wax paper and the like, the one end of which is connected through a clamping device to a switch acting on the infeed. The feeler band is placed onto the workpiece to be worked. Upon the approach of the grinding wheel, the feeler band is pulled between grinding wheel and workpiece and acts through the electric switch of the feed drive to stop the grinder. The thickness of the feeler band determines the distance between the active tool surface and the workpiece surface. However, operation of this portable device is complicated, because it must always be brought to the grinding point, whereupon the necessary connection of a cable through the device to the control panel or the control cabinet of the machine makes handling more difficult. Furthermore, the feeler band must be held manually between workpiece and grinding wheel, which particularly in the case of profile grinding can present difficulties. Finally it is necessary after each infeed to clamp a new piece of feeler band into the clamping device, because this feeler band is torn off upon contact of the grinding wheel.

Also stopping devices exist in which the feed drive is turned off, as soon as the grinding wheel has contacted the workpiece to be worked (German OS Nos. 2,044,083, 2,045,314 and spark indicator 9176 of the Firm CEJ Forster, Bad Nauheim). However, in these devices a disadvantageous requirement is that the grinding wheel must already be in engagement with the workpiece in order to deliver information controlling the infeed. If one considers the slowing-down time required in feed drives due to the mass forces, it will be understood that only limited fields of application are available for these devices, such as for rough grinding.

SUMMARY OF THE INVENTION

The basic purpose of the invention is to provide a device for ending the feed movement of a rotating tool, which is carried by a tool spindle, in particular a grinding wheel, which with only a simple structure, without mechanical auxiliary systems or other additional apparatus, and without contacting the workpiece, a precise termination of the feed movement upon reaching a predetermined small distance between the active tool surface and the workpiece surface and which will do so with the greatest possible exactness and operational certainty.

This is achieved according to the invention by providing a rotating tool with several conductors which are insulated with respect to said tool, the free ends of which conductors extend to but terminate at the active periphery of the tool. A high voltage is applied thereto by means of a voltage transformer rotating with the tool spindle with a characteristic impulse caused to appear between the conductor ends and the workpiece surface. A threshold switch is arranged in the primary circuit of the voltage transformer which acts onto the circuit of the tool feed and is adjusted to it through a spark discharge in the high voltage circuit. The high voltage produced by the voltage transformer is chosen such that upon reaching the predetermined distance a spark discharge between the conductor ends and the workpiece surface takes place and through the voltage change which thus occurs in the primary circuit the tool feed is turned off through the threshold switch.

The structure of the new device is extremely simple, is safe in operation and operates with the greatest possible exactness. Assuming approximately constant environmental conditions, like temperature, air pressure and humidity in the air at a constant form of the electrodes — here of the grinding wheel or the conductor ends and of the workpiece — at a given voltage the spark path is always of constant length. Thus, the spark discharge takes place at a constant voltage always at a certain distance of the grinding wheel from the workpiece. By selecting a suitable voltage, one can thus determine the distance at which the spark discharge takes place and thus at which the feed is stopped. The feed movement is stopped without the tool contacting the workpiece at an unsuitable time.

In a further development of the invention it is also possible during approach of the tool to a certain first distance to turn off the rapid traverse, to switch over at the same time to creep feed and then to turn off the creep feed upon reaching a predetermined small distance. To achieve this, the voltage transformer has on the secondary side several outputs with different voltage values. Upon application of a greater high voltage, the grinding wheel approaches a selected distance, at which a first spark discharge takes place and through this by means of the threshold switch the rapid traverse is immediately switched off, the voltage transformer and the threshold switch are switched to a lower voltage step and the creep feed is switched on. The tool now approaches the workpiece with a lesser feed speed and due to the lower voltage a spark discharge now takes place at a lesser distance of the active surface of the grinding wheel from the workpiece. The creep feed is then also turned off with the spark discharge through the threshold switch.

BRIEF DESCRIPTION OF THE DRAWINGS

The invention is discussed more in detail in connection with the several exemplary embodiments illustrated in the drawings, in which.

DETAILED DESCRIPTION

Figure 1:
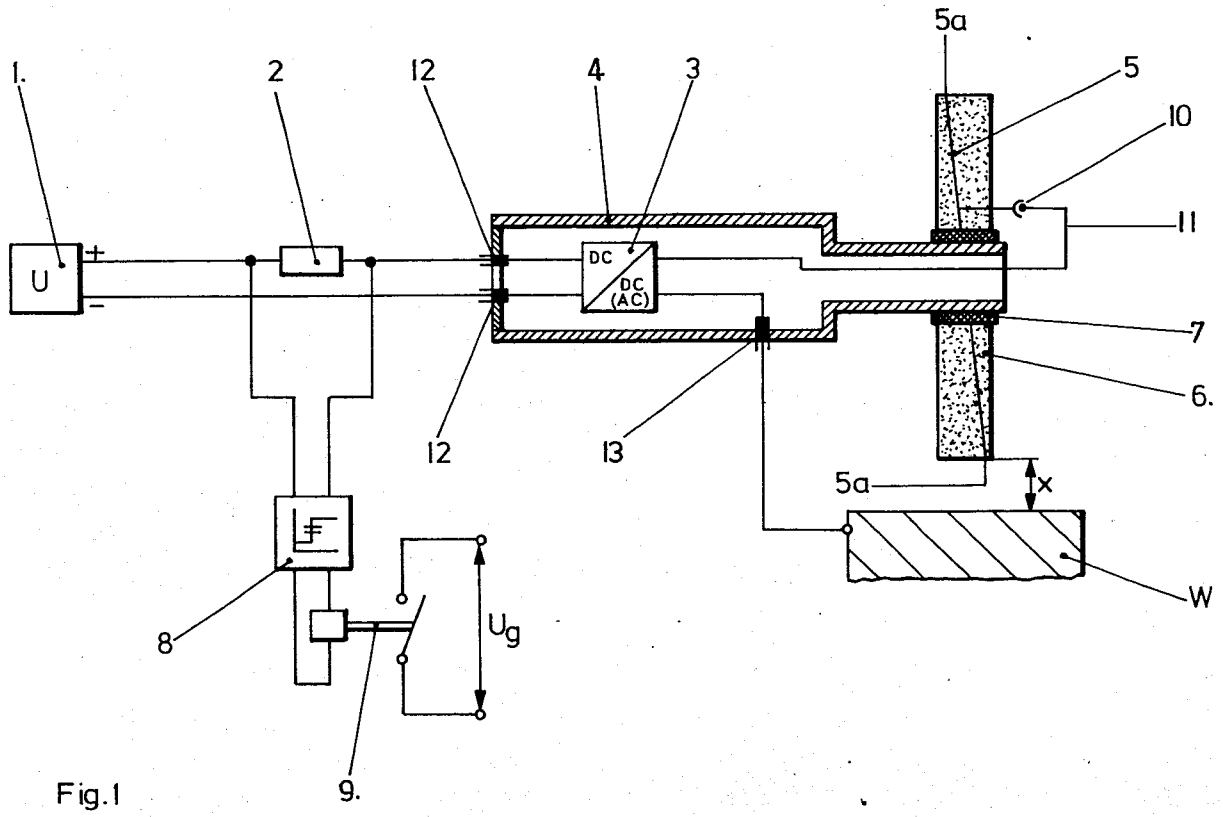
FIG. 1 is a schematic illustration of the switching circuit.

Prior to discussing more in detail the exemplary embodiments which are illustrated in the drawings, the term "high voltage" will be defined more in detail. Usually the term high voltage means a voltage of 1000 volts or more. However, in connection with the present application, the term high voltage is used for voltages above approximately 100 volts and the term low voltage for voltages below 100 volts. Voltages below 100 volts are sometimes also called safe voltage in the electrotechnology.

The reference numeral 1 identifies in the drawings a d.c. low voltage source, for example a 24 volt source, which supplies through a resistor 2 the primary winding of the voltage transformer 3. The voltage transformer 3 is a voltage transformer with an impulse characteristic, which produces in the secondary winding a pulsating d.c. voltage or an a.c. voltage with a suitable high voltage. The voltage transformer is arranged in the grinding spindle 4, whereby the low voltage is supplied in a conventional manner through sliding rings 12 or the like. The voltage transformer 3 is installed in the hollow grinding spindle 4 mainly for safety reasons. The high voltage, of for example 1000 – 3000 volts, which is produced in the secondary winding therefore does not need to be supplied through sliding rings or the like. The secondary winding of the voltage transformer is on one end connected to conductors 5 which are embedded in the grinding wheel 6, insulated with respect thereto, and the free ends 5*a* of which end at the active surface, here the periphery, of the grinding wheel, and the other end of said secondary winding is connected through a further sliding ring 13 to the workpiece W. Since the conductors 5 are insulated with respect to the grinding wheel 6, in this manner a high voltage is applied between the conductor ends 5*a* and the workpiece. The grinding wheel 6 is electrically insulated with respect to the grinding spindle by the insulating layer 7. A threshold switch 8 is arranged in the primary circuit, which threshold switch taps off through the resistor 2 the voltage drop which is effected by the hereinafter-described spark discharge and which operates the relay switch 9. The relay switch 9 is the output member of the measuring circuit and lies within the circuit of the feed drive. The low voltage source 1, the resistor 2, the threshold switch 8 and the relay switch 9 are advantageously arranged in the support or stationary part of the machine.

When the grinding wheel 6 approaches the workpiece W, a spark discharge between the conductor ends 5*a* and the workpiece takes place at a selected distance X. The distance X is always the same at a given voltage. The spark discharge in the secondary circuit causes in the primary circuit a voltage drop, which is detected by the threshold switch 8 and follows a selected voltage pattern in the primary circuit. The threshold switch 8 now acts in turn onto the relay switch 9 to de-energize the feed motor. After a certain slowing-down period, which is caused by the momentum in the feed drive, the rotating grinding wheel stops at a predetermined distance from the workpiece W. Since, however, in a given machine and at a selected feed speed, the slowing-down period is always the same, one can compensate said slowing-down period by selecting the appropriate high voltage. Also by selecting a larger or smaller high voltage, it is possible to predetermine the distance between the active surface, peripheral or other, of the grinding wheel and the workpiece at which the grinding wheel is stopped.

In using a voltage transformer, which has on the secondary side several outputs with different voltage values, it is possible to enlarge the circuit so that a desired feed path of the grinding wheel can be covered in the rapid traverse of the feed drive, after which it is switched over to a creep feed and finally after reaching a predetermined distance the feed drive is stopped entirely. The sequence is then such that during the rapid traverse a voltage of for example 1000 volts is applied between the conductor ends 5*a* and the workpiece, so that during a larger distance between the grinding wheel and the workpiece a spark discharge takes place. This spark discharge is detected by the threshold switch, which then switches off the rapid traverse through a relay switch and switches on the creep feed. Simultaneously therewith, the voltage transformer is switched to a lower voltage step of for example 100 volts and also the threshold switch is switched to a different step or to a different threshold value switch which is adjusted to the reduced voltage. The grinding wheel moves at a lower feed speed toward the workpiece and at a predetermined smaller distance a second spark discharge takes place, which then in the predescribed manner either switches off the creep feed entirely or switches over to a still lesser speed and a still lower voltage of the voltage transformer. In an ideal case, the creep feed could be switched off in this manner so that the feed drive is stopped, when the active surface of the grinding wheel just touches the workpiece.

Figure 2:
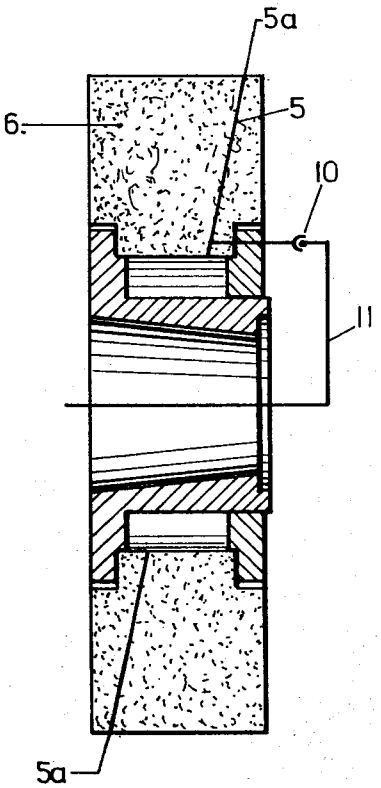
FIG. 2 is an axial cross-sectional view of a first exemplary embodiment of a grinding wheel usable in the inventive device.

An important characteristic of the present invention is the conductors arranged in the rotating tool and insulated with respect to said tool, the free ends of which conductors end at the active surface, here the periphery, of the tool. These conductors can be arranged in the form of a mesh grid in the grinding wheel, which mesh grid extends in the illustrated embodiments approximately perpendicularly to the grinding wheel axis. The mesh grid 5 is according to FIG. 2 advantageously slightly inclined with respect to the grinding wheel axis. The mesh grid 5 thus carries out a wobbling movement during rotation of the grinding wheel and sweeps over a line at its smallest distance from the workpiece surface, which line corresponds approximately to the width of the grinding wheel 6. Thus, the width of the workpiece to be worked has no effect on the operation of the inventive device. The mesh grid 5 can be connected through a plug connection 10 to the line 11 which leads to the voltage transformer 3. The electric conductors which are arranged within the grinding wheel are insulated against the grinding wheel material, in order to receive the desired voltage conditions. A grinding wheel is, since cooling fluids are usually used, moist internally due to its porosity and is thus an imprecise conductor even if during infeed operations are carried out briefly without cooling medium.

Figure 3:
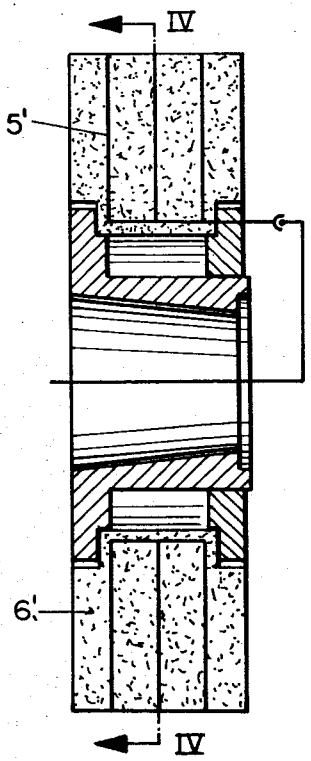
FIG. 3 is an axial cross-sectional view of a second exemplary embodiment of a grinding wheel.
Figure 4:
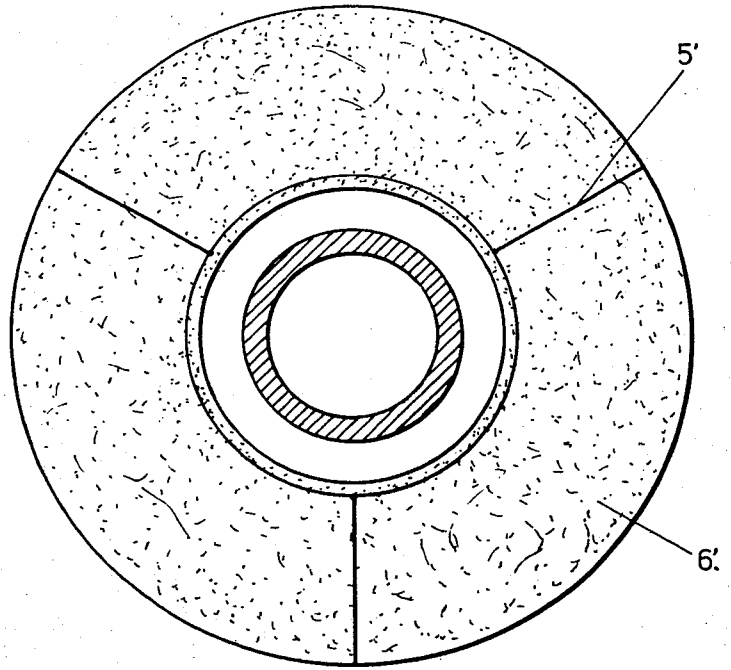
FIG. 4 is a radial cross-sectional view along the line IV—IV of FIG. 3.

FIGS. 3 and 4 show a further embodiment of a grinding wheel 6' having radially extending insulated conductors 5', which end also at the grinding wheel periphery. Here several conductors 5 can be arranged over the grinding wheel width, to create an independence from the workpiece width.

Still other conductor sensors adjusted to the respective grinding wheel profile are conceivable. In any case, the conductors and the insulating material must be constructed such that they wear uniformly during the grinding operation with the grinding wheel and do not affect the grinding finish achieved on the workpiece.

The high voltage part could if necessary also be supplied with a.c. voltage. The principle which is the basis of the invention could also be used for milling tools.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a device for terminating the relative feeding movement between a rotating grinding wheel carried by a rotatable tool spindle and a workpiece, the improvement comprising wherein said rotating grinding wheel has a plurality of electrical conductors insulated with respect to the material of said grinding wheel, the free ends of said conductors terminating at the active surface of said grinding wheel, rotatable voltage transformer means rotating with said tool spindle and generating an impulse characteristic between said free ends of said conductors and said workpiece surface, said voltage transformer means having a primary circuit and a high voltage secondary circuit and a low voltage secondary circuit, one side of both of said high voltage and low voltage secondary circuits being selectively electrically connected to said conductors and the other side thereof to said workpiece, feed drive means for effecting a relative movement between said grinding wheel and said workpiece at least toward each other, said feed drive means having a pair of differing speed characteristics so that said relative movement at one speed is faster than at the other speed, said high voltage circuit being electrically connected to said conductors when said feed drive means effects said fast relative movement between said grinding wheel and said workpiece, threshold switch means responsive to a spark discharge across a predetermined liquid free gap between said grinding wheel and said workpiece when said fast relative movement is occurring between said grinding wheel and said workpiece for (1) simultaneously switching said connection between said high voltage secondary circuit and said conductors to a connection between said low voltage second circuit and said conductors and (2) switching said feed drive means to the slower one of said speeds of relative movement.

2. The improved device according to claim 1, wherein said voltage transformer means produces a pulsed d.c. voltage in said high voltage secondary circuit.

3. The improved device according to claim 1, wherein said primary circuit includes a low voltage source of approximately 42 volts.

4. The improved device according to claim 3, wherein said voltage transformer means includes a voltage transformer having a primary part and a secondary part;

wherein said primary circuit includes said primary part and said low voltage source;

wherein said secondary circuits include said secondary part; and wherein only said primary and secondary parts rotate with said tool spindle, while the low voltage source is stationary.

5. The improved device according to claim 4, wherein said tool spindle is hollow; and wherein said voltage transformer means is arranged in said hollow tool spindle.

6. The improved device according to claim 4, wherein said secondary part has a plurality of outputs with different voltage values and correspondingly adjusted threshold switch means.

7. The improved device according to claim 1, wherein said free ends of said conductors are distributed over the active width of said grinding wheel.

8. The improved device according to claim 1, wherein said free ends of said conductors are arranged in the form of a mesh grid extending approximately perpendicularly with respect to the grinding wheel axis in said grinding wheel.

9. The improved device according to claim 8, wherein said mesh grid is inclined slightly with respect to said grinding wheel axis.

10. The improved device according to claim 1, wherein said conductors extend radially in said grinding wheel.

11. The improved device according to claim 7, wherein said conductors are connected to a contact point in the center of said grinding wheel.

* * * * *